299-13
2/19/80 OR 4,189,185

United States Patent [19]

Kammerer, Jr. et al.

[11] 4,189,185

[45] Feb. 19, 1980

[54] METHOD FOR PRODUCING CHAMBERED BLAST HOLES

[75] Inventors: Archer W. Kammerer, Jr., Tryon, N.C.; Gary R. Johnson, Yorba Linda, Calif.

[73] Assignee: Tri-State Oil Tool Industries, Inc., Los Angeles, Calif.

[21] Appl. No.: 726,947

[22] Filed: Sep. 27, 1976

[51] Int. Cl.[2] ..... E21C 41/00

[52] U.S. Cl. ..... 299/13; 175/65; 175/267

[58] Field of Search ..... 299/13, 5; 175/57, 65, 175/292, 406, 285, 286, 267, 263; 102/23

[56] References Cited

U.S. PATENT DOCUMENTS

| | | | |
|---|---|---|---|
| 245,160 | 8/1881 | Greek et al. | 175/286 |
| 1,621,812 | 3/1927 | Ross | 175/286 |
| 1,750,953 | 3/1930 | Boynton | 175/286 |
| 2,631,013 | 3/1953 | Darin | 61/53.6 X |
| 2,743,087 | 4/1956 | Layne et al. | 175/285 |
| 2,910,274 | 10/1959 | Scott | 175/267 |
| 3,032,128 | 5/1962 | Walton | 175/292 |
| 3,342,276 | 9/1967 | Beck, Jr. | 175/286 |
| 3,466,094 | 9/1969 | Haworth et al. | 299/13 |
| 3,561,550 | 2/1971 | Mays | 175/273 |
| 3,575,245 | 4/1971 | Cordary | 175/268 |
| 3,794,116 | 2/1974 | Higgins | 166/259 |
| 3,951,458 | 4/1976 | Cathles et al. | 299/5 |
| 4,031,972 | 6/1977 | Burg | 175/263 |

FOREIGN PATENT DOCUMENTS

| | | | |
|---|---|---|---|
| 129 | of 1887 | United Kingdom | 102/23 |

*Primary Examiner*—William F. Pate, III
*Attorney, Agent, or Firm*—Subkow and Kriegel

[57] ABSTRACT

A pilot hole of a preselected diameter is drilled with a suitable bit in an earth formation to a desired depth. The bit is withdrawn from the hole, and an expandable hole opener or underreamer run in the pilot hole with its cutters fully retracted and closely adjacent to each other. When the depth is reached at which enlargement of the pilot hole is to commence to produce a blast chamber, the cutters are forced laterally outwardly by fluid pressure while the hole opener is rotated, without moving the hole opener axially of the pilot hole, to cut the wall of the pilot hole and increase its diameter to the extent determined by maximum expansion of the cutters, thereby forming the upper end of the enlarged blast chamber. Rotation of the hole opener continues while it is progressively lowered to drill the blast chamber down to the bottom or lower end of the pilot hole, the bottom of the blast chamber produced by the hole opener lying in substantially the same plane as the bottom of the pilot hole to collectively form a single blast chamber bottom.

9 Claims, 5 Drawing Figures

METHOD FOR PRODUCING CHAMBERED BLAST HOLES

The present invention relates to the production of blast chambers in formations to receive explosives for fragmenting the formations. Such blast chambers are used in blowing off the bench in strip or open pit mining, coal gasification, and leach mining.

Heretofore, blast chambers have been produced in formations through use of a one-pass method, in which a lower pilot bit is secured, directly or indirectly to an expanding cutter type of bit, known as a hole opener or underreamer. This combination is secured to a string of drill pipe. An upper pilot hole is produced by the pilot bit to a desired depth in the formation which will be the location of the upper end of the proposed blast chamber. During the production of the pilot hole to the depth just referred to, the expandable cutters of the hole opener remain retracted or in inoperative condition. The hole opener cutters are then expanded, while the pilot bit and hole opener are rotated, to commence enlargement of the pilot hole and formation of the blast chamber, the combination being progressively lowered, with the pilot bit continuing to drill the pilot hole, and the hole opener thereabove the enlarged blast chamber, until the pilot bit reaches the desired final depth of the pilot hole. The result is the production of an upper pilot hole extending downwardly from the ground surface, an enlarged blast chamber extending downwardly from the upper pilot hole, and a lower pilot hole extending downwardly from the blast chamber.

There are many disadvantages to the one-pass method. Since the pilot bit and hole opener are in the hole at the same time, they are both subject to the drilling weight required for penetration of the pilot bit cutters into the formation, which urges the arms and cutters against the formation while the upper pilot hole is being produced and also exposes them to the cuttings carried upwardly by the drilling fluid, thereby subjecting their outer portions to wear. The wear on the cutters and arms, while the upper pilot hole is being drilled, and before chambering is to be performed, shortens the effective life of the chambering tool or hole opener.

Another disadvantage to the simultaneous presence of the pilot bit and hole opener in the hole, stems from the requirement for conducting drilling fluid through the drill pipe and hole opener to the pilot bit, which necessitates the presence of a fluid conductor in the hole opener, which limits the axial length of hole opener cutters that can be used, to insure their ability to be fully retracted within the confines of the hole opener body. The necessity for transmitting torque and drilling weight through the hole opener to the pilot bit requires sufficient steel structure in the hole opener between the retracted cutters, which allows space for small diameter cutters only in the hole opener tool. As a result, the cutters of small axial and radial size severely limit the diameter to which the hole produced by the pilot bit can be enlarged. In actual practice, such limit is a blast chamber or enlarged hole of about one and one-half times the diameter of the pilot hole.

Since a large increase in diameter of the pilot hole cannot be effected to produce the blast chamber, the latter must be made longer to receive the required large quantity of explosives. In addition, the pilot hole portion below the chamber will also be packed with explosives. As a result, the blasting force occurs along extended portions of the bench, as well as below the lower end of the bench, where a large portion of the blasting effect is reduced or is ineffective. Desirably, the chamber should be formed to the bottom of the enlarged hole only and should not include any pilot hole portion depending therefrom.

Because of the relatively small diameter of each blasting chamber, more chambered holes in spaced relation to each other and more rows of holes must be drilled to effectively blast the bench, which is time consuming and costly.

The present invention involves a two-pass method of producing blast chambers. First, a pilot hole of a preselected diameter is produced to total depth by a suitable drill bit. This bit is then removed from the hole. Secondly, a hole opener or underreamer having initially retracted cutters is secured to a drill string and lowered in the pilot hole to a location corresponding to the upper end of the chamber to be produced. The cutters are expanded while the hole opener is rotated to cut out the pilot hole and form the upper end of the enlarged chamber. With the cutters expanded, and the hole opener rotating, drilling weight is imposed on the tool and the tool progressively lowered to drill the enlarged chamber down to the bottom of the pilot hole, the chamber bottom coinciding with the bottom of the pilot hole.

The hole opener cutters, when in retracted position can be placed closely adjacent to each other and can, therefore, be of maximum axial extent, enabling the cutters to be expanded laterally to drill a chamber of much larger diameter than can be produced with the above described one-pass method. Additionally, since there is no pilot bit below the hole opener, the body of the latter need not embody any structure for feeding fluid to the pilot bit, which enables the cutters and the cutter bearings to be made of larger diameters and, therefore, have a much longer drilling life. Since chambers can be formed having considerably larger diameters, they can be spaced further apart and made of shorter length, requiring fewer chambered holes per unit of ground area.

The hole opener cutters and cutter supporting arms are subjected to much less wear than occurs in the single-pass method, since the hole opener or underreamer is in the hole only when the chamber is being formed, and not during the drilling of the smaller diameter pilot bore.

The hole opener cutters produce a blast chamber having a flat bottom; that is, the bottom of the enlarged portion of the bore and the bottom of the pilot hole lie in the same plane, avoiding the production of an unneeded and undesired pilot hole below the chamber. As a result, the explosives need not fill a pilot hole below the chamber, which is not required and costly to produce. The explosives in such lower pilot hole are also largely ineffectual.

This invention possesses many other advantages and has other purposes which may be made more clearly apparent from a consideration of a method embodying the invention. This method is shown and described in the present specification in connection with the drawings accompanying and constituting a part thereof. Such drawings and method will now be described in detail, for the purpose of illustrating the general principles of the invention; but it is to be understood that such detailed description is not to be taken in a limiting sense.

Referring to the drawings.

Figure 1:
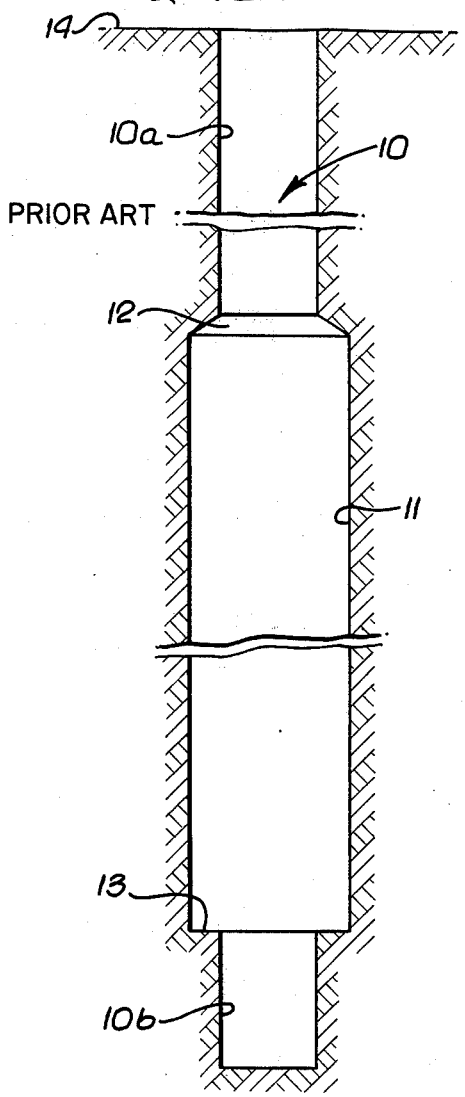
FIG. 1 is a diagrammatic view of a blast hole which has been produced through use of the above-described one-pass method.

FIG. 1 illustrates a pilot hole 10 and blast chamber 11 produced with the one-pass method, in which a pilot bit (not shown) is secured, directly or through an intervening member, to the lower end of an underreamer or hole opener (not shown) having expandable cutters. The pilot bit and hole opener can be of known constructions and are, therefore, not illustrated. The upper portion 10*a* of the pilot hole is drilled by the pilot bit with the usual hole opener body, cutter arms and cutters subject to the action of the drilling fluid which causes their wear, expansion of the arms and cutters occurring after the hole opener cutters reach a location 12 at which the pilot hole is to be enlarged in diameter to form the blast chamber 11. At that time, the cutter arms and cutters are expanded outwardly to enlarge the top portion of the pilot hole to a particular diameter, whereupon continued rotation of the hole opener and pilot bit will produce the pilot hole in advance of the hole opener, and permit the cutters of the latter to enlarge the pilot hole to a particular diameter. The drilling continues until the cutters have enlarged the pilot hole down to a desired location or bottom 13. However, the pilot bit will also form a lower portion 10*b* of the pilot hole below the bottom 13 of an enlarged hole or blast chamber 11.

The disadvantages of using the combination pilot bit and hole opener in performing the one-pass method of producing the blast chamber have been noted above. In practice, it is possible to enlarge the pilot hole diameter about 50%, because of the relatively small size of the cutters that can be used in the expansible hole opener or underreamer tool.

Figure 2:
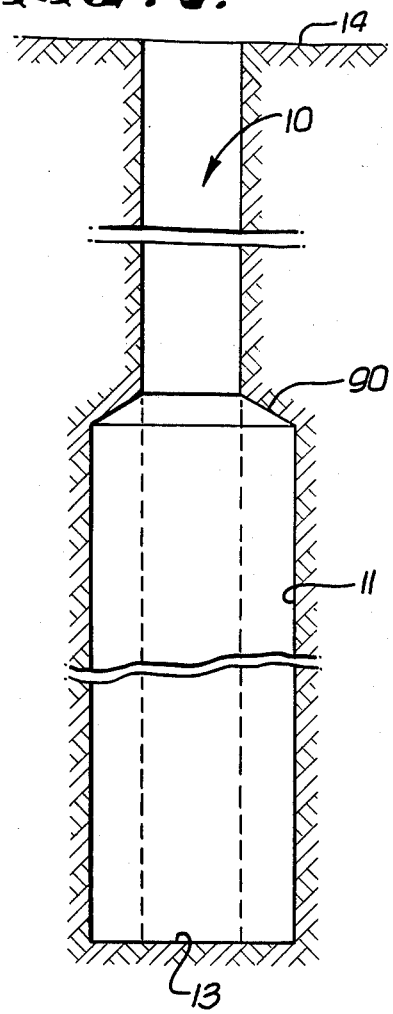
FIG. 2 is a diagrammatic view of a blast hole or chamber produced with the two-pass method which constitutes the present invention.

By virtue of the present invention, a two-pass method is practiced in which the pilot hole 10 is first drilled from the surface 14 of the ground down to the desired bottom location 13 of the proposed blast chamber, as shown in broken lines in FIG. 2. The pilot bit and the drill pipe string secured thereto are then removed from the hole and a hole opener or underreamer 15, shown in FIGS. 3, 4, attached to the string of drill pipe 22. The hole opener cutters 16, which can be of the roller type, form the terminal portion of the hole opener tool. There are no obstructions in the tool to the full retraction of the cutters within the confines of the hole opener body 17. Each cutter can have an axial extent equalling the axial extent of the cutters used on the pilot bit, so that the cutters can be expanded outwardly until the inner cutter portions 18 of each cutter are located at the wall 19 of the pilot hole, and with the outer reamer portion 70 of each cutter located at the wall 71 of the enlarged hole or blast chamber 11. This ability to expand the cutters outwardly to a greater extent than the cutters of a hole opener run in the pilot hole with a pilot bit depending therefrom enables the blast chamber to be produced with a diameter twice the diameter of the pilot hole 10. In fact, it is possible to increase the diameter of the blast chamber more than twice the diameter of the pilot hole through using different lengths of cutters 16 in the hole opener, in which one of the cutters can have its inner portion extend across the axis of the hole opener tool when the cutters are in retracted position. Such an arrangement is illustrated and described in U.S. Pat. No. 2,941,785.

The rotation of the hole opener 15 will continue, and its downward feeding with its cutters 16 expanded continued, until the bottom 13 of the pilot hole is reached by the cutters, resulting in the production of a comparatively flat bottom across the entire enlarged blast chamber 11, with no lower pilot hole being formed.

The hole opener can then be removed from the blast chamber 11 and upper pilot hole portion 10, with its cutters having first been placed in retracted position, in a known manner.

Figure 3:
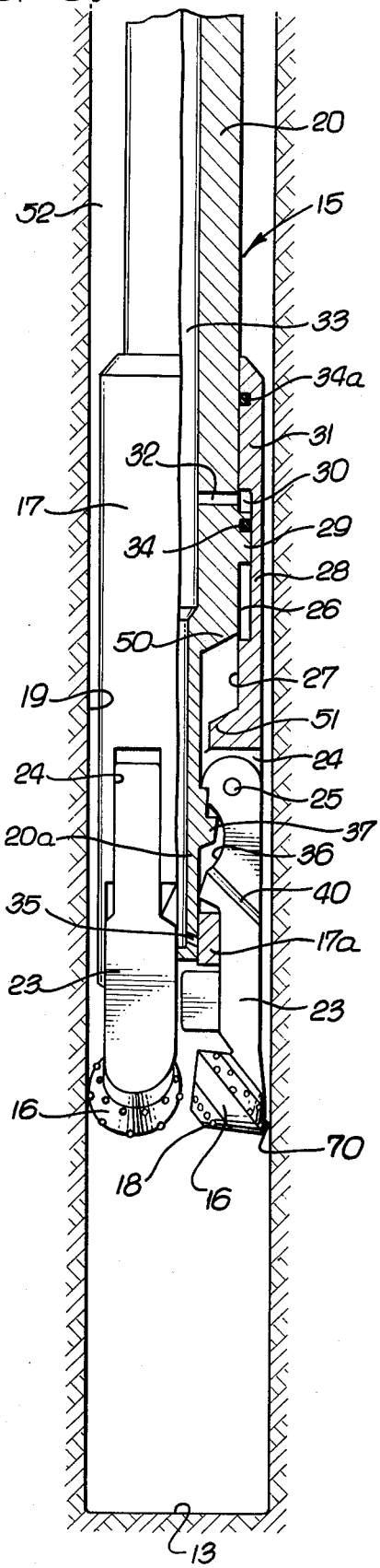
FIG. 3 is a longitudinal section and side elevational view of a hole opener or underreamer with its cutters in retracted position and located to commence enlarging the diameter of a previously drilled pilot hole to produce the blast chamber disclosed in FIG. 2.
Figure 4:
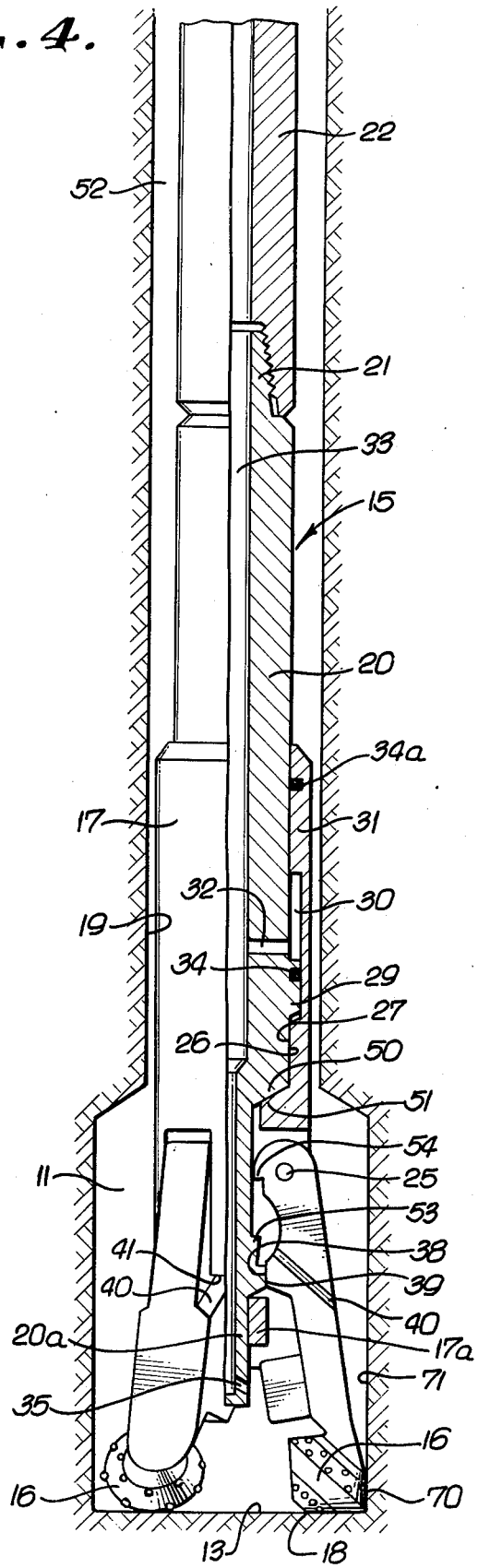
FIG. 4 is a view similar to FIG. 3, illustrating the cutters having been expanded and the blast chamber enlarged to the bottom of the previously drilled pilot hole.

A hole opener apparatus for producing the blast chamber disclosed in FIG. 2 is illustrated in FIGS. 3 and 4 in a partially diagrammatic fashion. This tool is essentially the same as disclosed in U.S. Pat. No. 2,941,785, except that its cutters 16 form the lowermost portion of the tool, to permit the cutters to be disposed closely adjacent one another when in retracted position. In fact, as noted above, one of the cutters can be provided extending radially inwardly across the axis of the tool, in accordance with the teachings of the above patent.

The hole opener 15 includes a mandrel 20 having a threaded pin 21 for threadedly securing it to the lower end of the string of drill pipe 22, which will extend to the top of the pilot hole previously drilled, and which is rotated by suitable and well known mechanism (not shown) at the top of the hole to effect the enlargement of the borehole. This mandrel is piloted within the main body 17 of the tool, which has a plurality of cutter supporting arms 23 disposed in body slots 24 and pivotably mounted on hinge pins 25 bridging the slots and suitably secured to the body of the tool. The lower end of each supporting arm carries an appropriate conical type of roller cutter 16, which can extend under the lower end of the body 17 of the tool when the supporting arms and cutters are in their fully retracted position, as disclosed in FIG. 3. The mandrel has a non-circular portion 26 which can be slidably moved longitudinally along a companion non-circular socket 27 in the body of the tool above the body slots, to transmit the rotation of the mandrel 20 to the body 17 and from the body through the cutter supporting arms 23 to the cutters 16.

The upper portion of the body constitutes a cylinder 28 slidably longitudinally with respect to a piston 29 integral with the mandrel, there being a cylinder space 30 between the piston and an upper cylinder head 31 into which fluid, such as compressed air, is directed through one or a plurality of mandrel ports 32 communicating with the central passage 33 through the mandrel, for the purpose of elevating the cylinder and body 17 upwardly along the mandrel 20, in order to secure outward expansion of the supporting members 23 and cutters 16. A suitable seal 34 is provided on the piston for slidably and sealingly engaging the wall of the cylinder. A like seal 34a is mounted in the cylinder head 31 which is slidably and sealingly engageable with the periphery of the mandrel above its ports 32.

The lower portion 20a of the mandrel is slidable within a suitable bridge portion 17a of the body, this lower portion having suitable side ports 35 communicating with the central passage 33 of the mandrel, but which are initially closed when the cutters are in retracted position by the bridge portion 17a of the body (FIG. 3). When the cutters are to be expanded, compressed air is forced down the drill string 22 and mandrel passage 33, which passes through the ports 32 into the cylinder space 30, urging the body 17, supporting arms 23 and cutters 16 in an upward direction along the mandrel. Expander surfaces 36 in the upper portions of the arms will slide along a mandrel expander 37, which will move the supporting arms 23 about their pivot pins 25 outwardly of the body, the outer portions of the cutters 16 engaging the wall of the pilot hole and enlarging it while the rotary drill string 22 and the tool 15 connected thereto are being rotated. As the cutters 16 continue to enlarge the pilot hole 10, the body 17 of the tool shifts upwardly along the mandrel 20 to a fuller extent, until lock surfaces 38 on the supporting arms are disposed along companion lock surfaces 39 on the mandrel expander. At this time shoulders 40 on each supporting arm will engage companion body shoulders 41 on opposite sides of the slot to limit the extent of expansion of the arms and of the cutters rotatably carried thereby, the co-engaging holding surfaces 38, 39 preventing any inward retraction of the supporting arms and cutters.

With the cutters locked in their outwardly expanded position, a downwardly facing shoulder 50 on the mandrel will engage a companion upwardly facing shoulder 51 on the body 17, enabling drilling weight to be imposed from the drill string 22 through the mandrel 20 to the body 17, and from the body through the hinge pins 25 and the co-engaging stop surfaces 40, 41 to the supporting arms 23 and cutters 16. With the cutters fully expanded, the mandrel will have been relatively shifted downwardly below the bridge portion 17a of the body, enabling the compressed air to discharge through the side ports 35 toward the cutters 16 to clean and cool them and force the cuttings upwardly around the tool 15 and through the annulus 52 around the drill pipe string 22 to the top of the borehole. The cutting action will proceed in a downward direction until the bottom 13 of the blast chamber 11 is reached, the hole having been enlarged to a much greater extent than with the one-pass method, as disclosed in FIG. 2.

The hole opener can now be withdrawn from the borehole. The pressure in the tool is relieved and the drill pipe string 22 elevated, which will elevate the mandrel 20 within the body 17, until a shoulder 53 of the mandrel engages a companion inwardly directed lug 54 on the upper portion of each arm 23, swinging the supporting members or arms and cutters 16 in an inward direction fully within the confines of the body 17 of the tool. The tool can now be elevated through the upper portion of the pilot hole 10 to the top of the ground.

Figure 5:
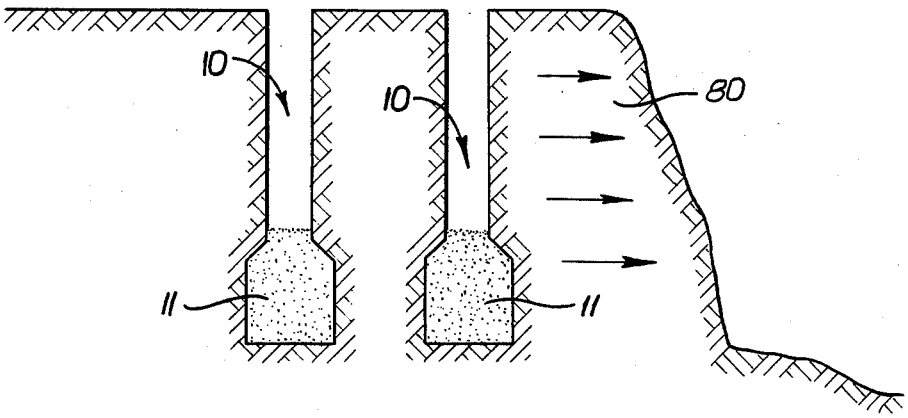
FIG. 5 is a diagrammatic view of a plurality of blast chambers produced in the formation, each corresponding to FIG. 2 and used for blasting a bench in surface mining.

In known manner, the explosive is placed in the blast chamber 11 and detonated to fracture the formation. In the case of blasting a bench 80 in a surface mining operation (FIG. 5), a known procedure is followed of drilling several rows of blast hole chambers, packing them with explosives, and simultaneously detonating the explosives in all holes to blast the bench and effect its fragmentation.

The advantages of the two-pass method have been pointed out above, including the concentration of a larger volume of explosive in each chamber 11 located at the optimum position with respect to the lower end of the bench. Because of the greater charge that can be put in each blast chamber, they can be spaced further apart for each row of blast chambers, and the rows themselves can be spaced further from one another. In addition, each chamber can be of less length, reducing the time for producing the blast chamber. As a result, large economies in drilling equipment and time result.

Wear on the hole opener 16 cutters and their supporting arms 23 is also considerably reduced, inasmuch as the hole opener is not disposed in the pilot hole 10 during drilling of the latter. When the lower portion of the previously produced pilot hole is to be enlarged to form the blast chamber 11, the hole opener or underreamer 15 is lowered through the upper portion of the pilot hole without any pressure being present in the string of drill pipe and the tool itself. As a result, there are no forces present tending to expand the supporting arms 23 and cutters 16 outwardly. It is only when the upper location 90 of the blast chamber to be produced has been reached that fluid pressure is imposed in the tool for the purpose of urging its cutters and the supporting arms outwardly to cut into the formation and commence the production of the enlarged blast chamber. As previously pointed out, a pilot hole below the chamber is not produced. Such chamber in the one-pass method results in a pilot hole 10b of extended length below the blast chamber, particularly in the event that a stabilizer is mounted between the underreamer and the pilot bit. Not only is the drilling of the lower pilot hole costly, but the explosives placed in such lower pilot hole is substantially ineffective in disintegrating the formation.

The two-pass method of producing blast chambers has other specific uses than in strip or open pit mining. Pilot holes and associated chambers can be drilled in underground coal seams, mineral deposits. Explosives can be placed in each chamber to fragment or fracture the surrounding formation. In the case of a coal strata, an appropriate medium can be pumped into the enlarged chamber and fractured formation to gasify the coal. With respect to mineral deposits, a leaching agent is pumped into the fragmented formation to release the minerals.

The inventors claim:

1. A method of mining by forming blast chambers in earth formation, comprising drilling a pilot bore hole of a pre-selected diameter in the formation with a pilot drill bit and to a predetermined bottom depth, removing the drill bit from the pilot bore hole, then lowering on a pipe string a hole opener having initially retracted cutters in the pilot bore hole to an upper location spaced a pre-selected distance above the bottom of the previously formed pilot bore hole, circulating drilling fluid through said pipe string and expanding the cutters while rotating the hole opener to form an upwardly facing shoulder in said formation and lowering the hole opener to progressively remove said formation shoulder and enlarge the pilot bore hole progressively downwardly from said upper location to the bottom of said pilot bore hole to produce a substantially cylindrical blast chamber greater in diameter than the diameter of the pilot bore hole and having a bottom substantially coplanar with the bottom of said pilot bore hole, removing the hole opener from the bore hole, placing an explosive in the blast chamber; and detonating said explosive.

2. A method as defined in claim 1; said cutters being pivotally expansible on axes transverse to the axis of rotation of said hole opener with the inner portions of said initially retracted cutters being closely adjacent each other and said cutters forming the lower terminal portion of said hole opener, whereby said cutters when expanded produce a bottom annular portion of the enlarged blast chamber which lies substantially in the same plane as and forms a lateral continuation of the bottom of said pilot bore hole.

3. A method as defined in claim 1; said cutters being pivotally expansible on axes transverse to the axis of rotation of said hole opener with the inner portions of said initially retracted cutters being closely adjacent each other and said cutters forming the lower terminal portion of said hole opener, whereby said cutters when expanded produce a bottom annular portion of the enlarged blast chamber which lies substantially in the same plane as and forms a lateral continuation of the bottom of said pilot bore hole, at least one of said expanded cutters extending laterally from the perimeter of said pilot bore hole to the wall of said enlarged blast chamber.

4. A method as defined in claim 1; said cutters being pivotally expansible on axes transverse to the axis of rotation of said hole opener with the inner portions of said initially retracted cutters being closely adjacent each other and said cutters forming the lower terminal portion of said hole opener, whereby said cutters when expanded produce a bottom annular portion of the enlarged blast chamber which lies substantially in the same plane as and forms a lateral continuation of the bottom of said pilot bore hole, at least one of said expanded cutters being of such extent from its pivot axis as to produce a blast chamber having a diameter at least twice as great as the diameter of said pilot bore hole.

5. A method as defined in claim 1; producing one or more of said blast chambers adjacent a bench face of said formation, placing explosive in each of said one or more chambers, and detonating said explosive in said one or more chambers.

6. A method as defined in claim 2; producing one or more of said blast chambers adjacent a bench face of said formation, placing explosive in each of said one or more chambers, and detonating said explosive in said one or more chambers.

7. A method as defined in claim 1; said cutters being pivotally expansible on axes transverse to the axis of rotation of said hole opener with the inner portions of said initially retracted cutters being closely adjacent each other and said cutters forming the lower terminal portion of said hole opener, whereby said cutters when expanded produce a bottom annular portion of the enlarged blast chamber which lies substantially in the same plane as and forms a lateral continuation of the bottom of said pilot bore hole, at least one of said expanded cutters extending laterally from the perimeter of said pilot bore hole to the wall of said enlarged blast chamber, producing one or more of said blast chambers adjacent a bench face of said formation, placing explosive in each of said one or more chambers, and detonating said explosive in said one or more chambers.

8. A method as defined in claim 1; said cutters being pivotally expansible on axes transverse to the axis of rotation of said hole opener with the inner portions of said initially retracted cutters being closely adjacent each other and said cutters forming the lower terminal portion of said hole opener, whereby said cutters when expanded produce a bottom annular portion of the enlarged blast chamber which lies substantially in the same plane as and forms a lateral continuation of the bottom of said pilot bore hole, at least one of said expanded cutters being of such extent from its pivot axis as to produce a blast chamber having a diameter at least twice as great as the diameter of said pilot bore hole, producing one or more of said blast chambers adjacent to a bench face of said formation, placing explosive in each of said one or more chambers, and detonating said explosive in said one or more chambers.

9. The method of mining by forming blast chambers in an earth formation, comprising drilling a pilot bore hole of a preselected diameter in the earth formation with a pilot bit and to a predetermined depth, removing the drill bit from the pilot bore hole; then lowering on a pipe string a hole opener having roller cone cutters rotatable on the free ends of pivot arms pivotal on axes transverse to the axis of the hole opener from initially retracted positions at which said cutters form the lowermost end of the hole opener; the inner ends of said cutters being closely adjacent to each other when in a fully retracted position and underlying central portions of said hole opener thereabove; positioning said hole opener a pre-selected distance above the bottom of said pilot bore hole; pivoting said arms outwardly while rotating said pipe string and hole opener and circulating drilling fluid through said pipe string and hole opener to form an upwardly facing shoulder in said formation with at least one of said cutters of such axial extent as to form an enlarged cylindrical chamber approximately twice the diameter of said pilot bore hole; moving said hole opener downwardly to remove said shoulder to the bottom of said pilot bore hole while circulating said drilling fluid to flush cuttings from the chamber and upwardly through said pilot bore hole; removing the pipe string and hole opener from the pilot bore hole; placing an explosive in the chamber; and detonating said explosive.

* * * * *